US007541993B2

(12) United States Patent
Tsai et al.

(10) Patent No.: US 7,541,993 B2
(45) Date of Patent: Jun. 2, 2009

(54) ANTENNA DEVICE WITH A DUAL-LOOP RADIATING ELEMENT

(75) Inventors: Tiao-Hsing Tsai, Yungho (TW); Chao-Hsu Wu, Tao Yuan Shien (TW); Chi-Yin Fang, Pingtung Shien (TW)

(73) Assignee: Quanta Computer Inc. (TW)

( * ) Notice: Subject to any disclaimer, the term of this patent is extended or adjusted under 35 U.S.C. 154(b) by 0 days.

(21) Appl. No.: 12/072,796

(22) Filed: Feb. 28, 2008

(65) Prior Publication Data

US 2009/0109105 A1 Apr. 30, 2009

(30) Foreign Application Priority Data

Oct. 29, 2007 (TW) ..... 96140555 A

(51) Int. Cl.
*H01Q 1/24* (2006.01)

(52) U.S. Cl. ..... 343/702; 343/866; 343/867

(58) Field of Classification Search ..... 343/702, 343/866, 867, 741, 742
See application file for complete search history.

(56) References Cited

U.S. PATENT DOCUMENTS 6,958,737 B2 * 10/2005 Lee et al. ..... 343/866
7,474,267 B2 * 1/2009 Chen et al. ..... 343/702

* cited by examiner

*Primary Examiner*—Hoang V Nguyen
(74) *Attorney, Agent, or Firm*—Ohlandt, Greeley, Ruggiero & Perle, L.L.P.

(57) ABSTRACT

An antenna device includes a dual-loop radiating element, first and second radiating arms, a feeding element, and a grounding element. The dual-loop radiating element has first and second loops. Each of the first and second radiating arms is disposed in a respective one of the first and second loops. The feeding element interconnects the first and second loops and the first and second radiating arms. The grounding element is connected to the first and second loops.

16 Claims, 7 Drawing Sheets

H Plane(X-Y Plane, Θ =90)

Peak = -0.61 dBi, Avg. = -4.34 dBi.

E1 Plane(X-Z Plane, Φ =0)

Peak = -0.48 dBi, Avg. = -5.4 dBi.

E2 Plane(Y-Z Plane, Φ =90)

Peak = 1 dBi, Avg. = -3.89 dBi.

H Plane(X-Y Plane, Θ =90)

Peak = 1.77 dBi, Avg. = -3.58 dBi.

E1 Plane(X-Z Plane, Φ =0)

Peak = 1.04 dBi, Avg. = -5.93 dBi.

E2 Plane(Y-Z Plane, Φ =90)

Peak = 3.5 dBi, Avg. = -1.5 dBi.

H Plane(X-Y Plane, Θ =90)

Peak = 1.45 dBi, Avg. = -4.64 dBi.

E1 Plane(X-Z Plane, Φ =0)

Peak = 0.47 dBi, Avg. = -5.46 dBi.

E2 Plane(Y-Z Plane, Φ =90)

Peak = 2.38 dBi, Avg. = -2.86 dBi.

ANTENNA DEVICE WITH A DUAL-LOOP RADIATING ELEMENT

CROSS-REFERENCE TO RELATED APPLICATION

This application claims priority of Taiwanese application No. 096140555, filed on Oct. 29, 2007.

BACKGROUND OF THE INVENTION

1. Field of the Invention

This invention relates to an antenna device, more particularly to an antenna device that includes a dual-loop radiating element.

2. Description of the Related Art

A conventional planar inverted-F antenna (PIFA), which is operable within the ultra wide bandwidth (UWB) Band I, i.e., between 3168 MHZ and 4752 MHZ, is typically used in notebook computers.

Although the conventional PIFA achieves its intended purpose, the conventional PIFA has an insufficient bandwidth.

SUMMARY OF THE INVENTION

Therefore, the object of the present invention is to provide an antenna device that can overcome the aforesaid drawback of the prior art.

According to the present invention, an antenna device comprises a dual-loop radiating element, first and second radiating arms, a feeding element, and a grounding element. The dual-loop radiating element has first and second loops, each of which has opposite first and second ends. Each of the first and second ends of the first loop is connected to a respective one of the first and second ends of the second loop. The first radiating arm is disposed in the first loop. The second radiating arm is disposed in the second loop and is connected to the first radiating arm. The feeding element interconnects a junction of the first ends of the first and second loops and a junction of the first and second radiating arms. The grounding element is connected to a junction of the second ends of the first and second loops.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
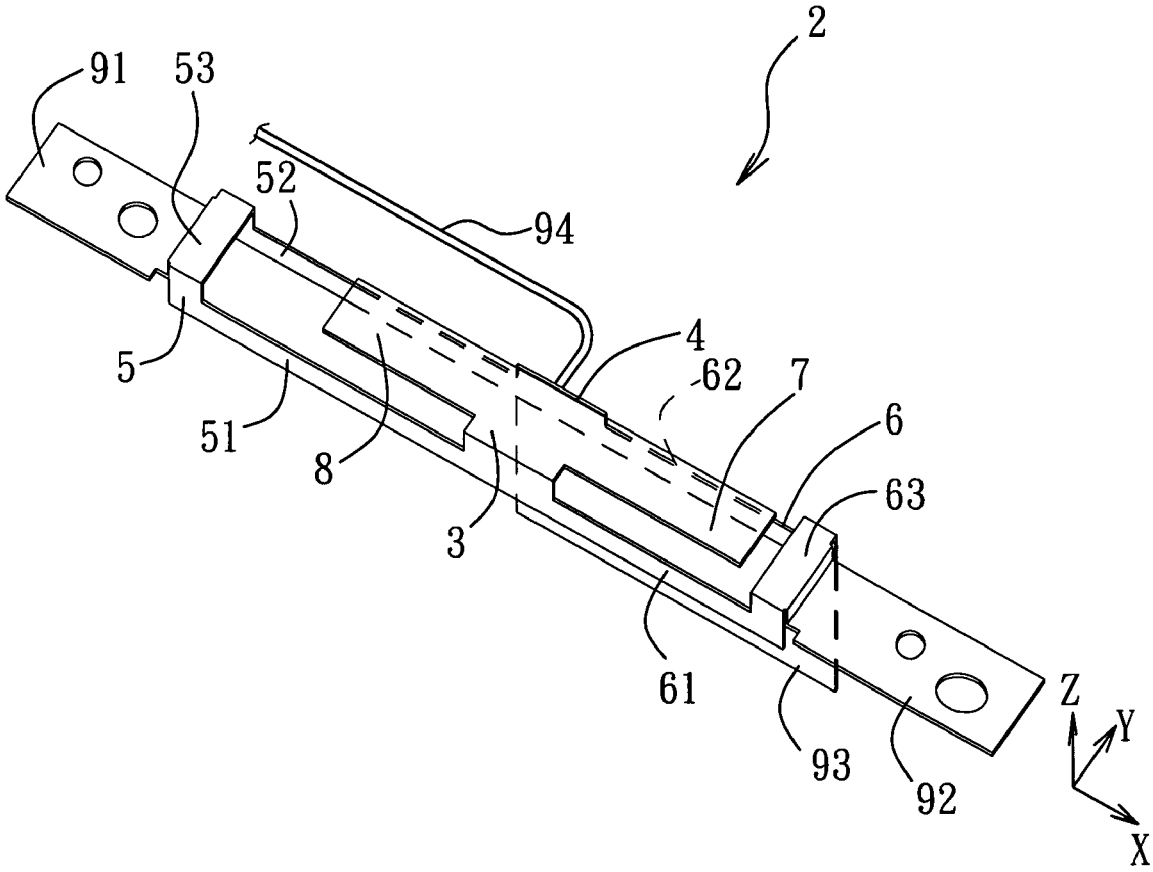
FIG. 1 is a perspective view of the preferred embodiment of an antenna device according to the present invention.

Referring to FIG. 1, the preferred embodiment of an antenna device 2 according to this invention is shown to include a dual-loop radiating element, first and second radiating arms 8, 7, a feeding element 3, and a grounding element 4.

Figure 2:
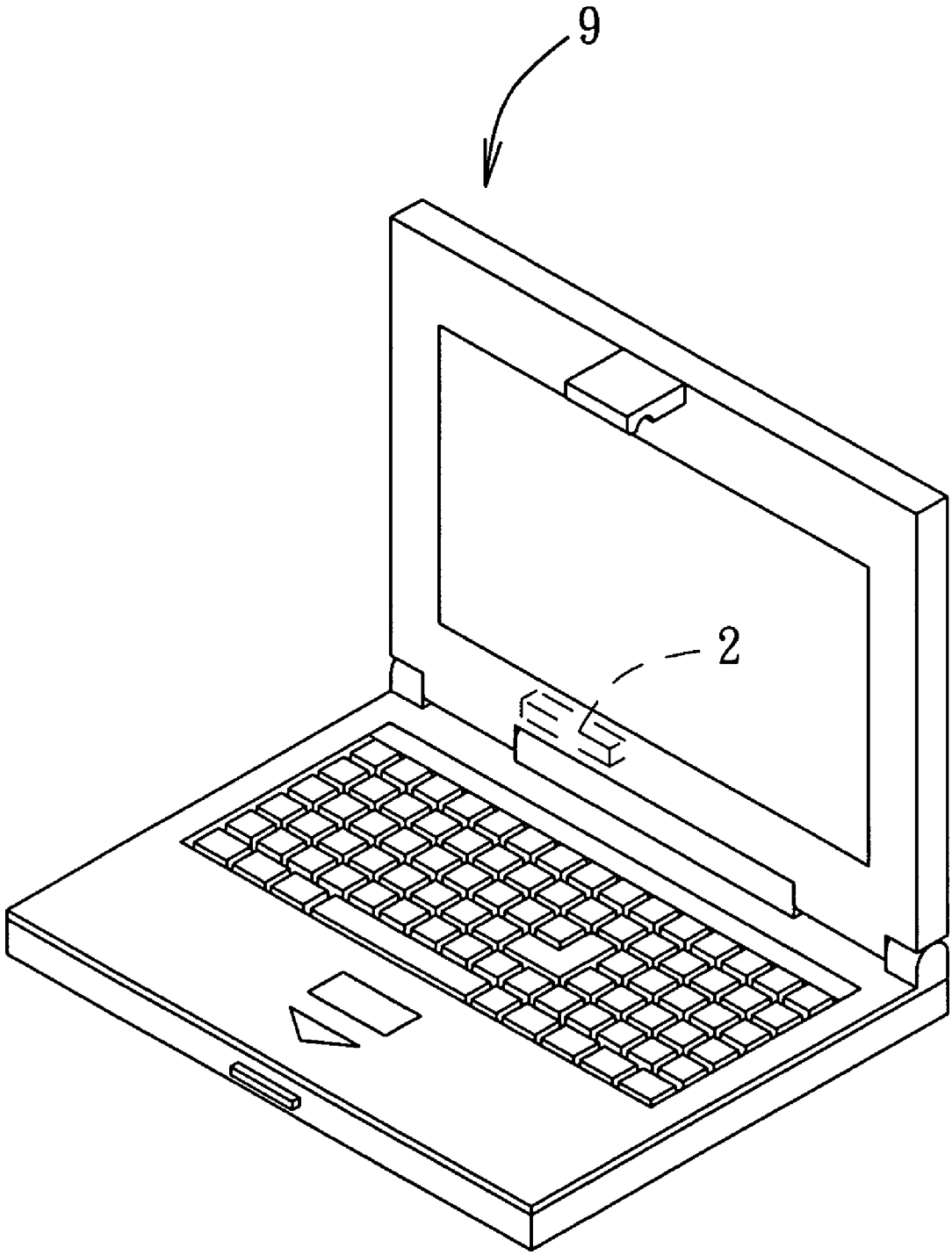
FIG. 2 is a perspective view to illustrate an exemplary application in which the preferred embodiment is installed in a notebook computer.

The antenna device 2 of this invention is an ultra-wide bandwidth (UWB) antenna device, is operable within the UWB Band I, i.e., between 3168 MHz and 4752 MHz, has a three-dimensional shape, and is mounted in a notebook computer 9, as illustrated in FIG. 2.

Figure 3:
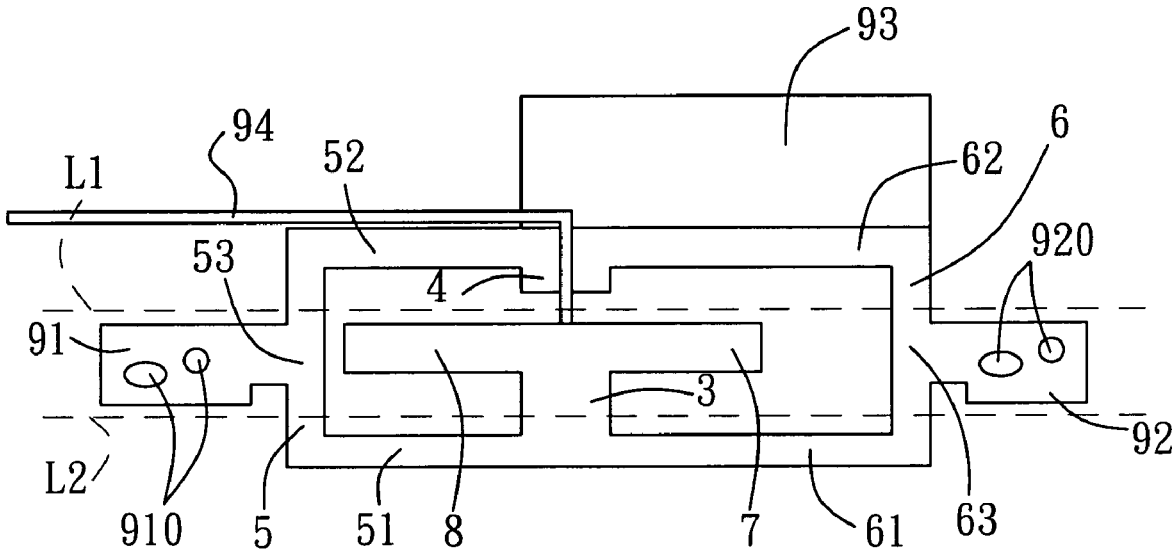
FIG. 3 is a schematic view to illustrate a state where the preferred embodiment is flattened to extend along a plane.

With further reference to FIG. 3, the dual-loop radiating element has first and second loops 5, 6. The first loop 5 includes first, second, and third sections 51, 52, 53, each of which has opposite first and second ends. Each of the first and second ends of the third section 53 of the first loop 5 is connected to a respective one of the second end of the first section 51 of the first loop 5 and the first end of the second section 52 of the first loop 5. The second loop 6, like the first loop 5, includes first, second, and third sections 61, 62, 63, each of which has opposite first and second ends. Each of the first and second ends of the third section 63 of the second loop 6 is connected to a respective one of the second end of the first section 61 of the second loop 6 and the first end of the second section 62 of the second loop 6. The first end of the first section 61 of the second loop 6 is connected to the first end of the first section of the first loop 5. The second end of the second section 62 of the second loop 6 is connected to the second end of the second section 52 of the first loop 5.

In this embodiment, the first and second sections 51, 52 of the first loop 5 are parallel. Moreover, the first and second sections 61, 62 of the second loop 6 are parallel. Further, the third sections 53, 63 of the first and second loops 5, 6 are parallel.

The first radiating arm 8 is disposed in the first loop 5, and is parallel to the first and second sections 51, 52 of the first loop 5.

The second radiating arm 7 is disposed in the second loop 6, is parallel to the first and second sections 61, 62 of the second loop 6, and is connected to the first radiating arm 8.

The feeding element 3 interconnects a junction of the first ends of the first sections 51, 61 of the first and second loops 5, 6 and a junction of the first and second radiating arms 8, 7.

The grounding element 4 is connected to a junction of the second ends of the second sections 52, 62 of the first and second loops 5, 6.

In this embodiment, the feeding and grounding elements 3, 4 are collinear. The antenna device 2 further includes first and second securing members 91, 92. The first securing member 91 is formed with a pair of holes 910 therethrough, and is connected to the third section 53 of the first loop 5 at a position between the first and second ends of the third section 53 of the first loop 5. The second securing member 92 is formed with a pair of holes 920 therethrough, and is connected to the third section 63 of the second loop 6 at a position between the first and second ends of the third section 63 of the second loop 6. As such, the antenna device 2 of this invention may be secured to the notebook computer with the use of two pairs of screws (not shown), in a manner well known in the art.

It is noted herein that the first and second sections 51, 52 of the first loop 5, the first and second sections 61, 62 of the second loop 6, and the first and second radiating arms 8, 7 are flat. Moreover, the third sections 53, 63 of the first and second loops 5, 6 and the feeding element 3 are bent along the lines (L1, L2) such that the first section 51, 61 of each of the first and second loops 5, 6 extends along a first plane, such that each of the first and second radiating arms 8, 7 extends along a second plane transverse to the first plane, and such that the second section 52, 62 of each of the first and second loops 5, 6 extends along a third plane parallel to the first plane.

The antenna device 2 further includes a copper foil element 93 and a transmission line 94. The copper foil element 93 is connected to the grounding element 4 through the second section 62 of the second loop 6 and is further connected to an electrical ground (not shown) of the notebook computer 9. The transmission line 94 has positive and negative terminals, each of which is connected to a respective one of the feeding and grounding elements 3, 4.

It is noted herein that the first loop 5 is associated operably with the feeding and grounding elements 3, 4 to generate a first resonant frequency. On the other hand, the second loop 6 is associated operably with the feeding and grounding elements 3, 4 to generate a second resonant frequency different from the first resonant frequency. Moreover, each of said first and second radiating arms 8, 7 has a predetermined length and a predetermined impedance such that each of the first and second resonant frequencies is within the UWB Band I, i.e., between 3168 MHz and 4752 MHz. Further, the length of each of the first and second radiating arms 8, 7 may be simply adjusted such that each of the first and second resonant frequencies is within the UWB, i.e., between the 3.1 GHz and 10.6 GHz.

Figure 4:
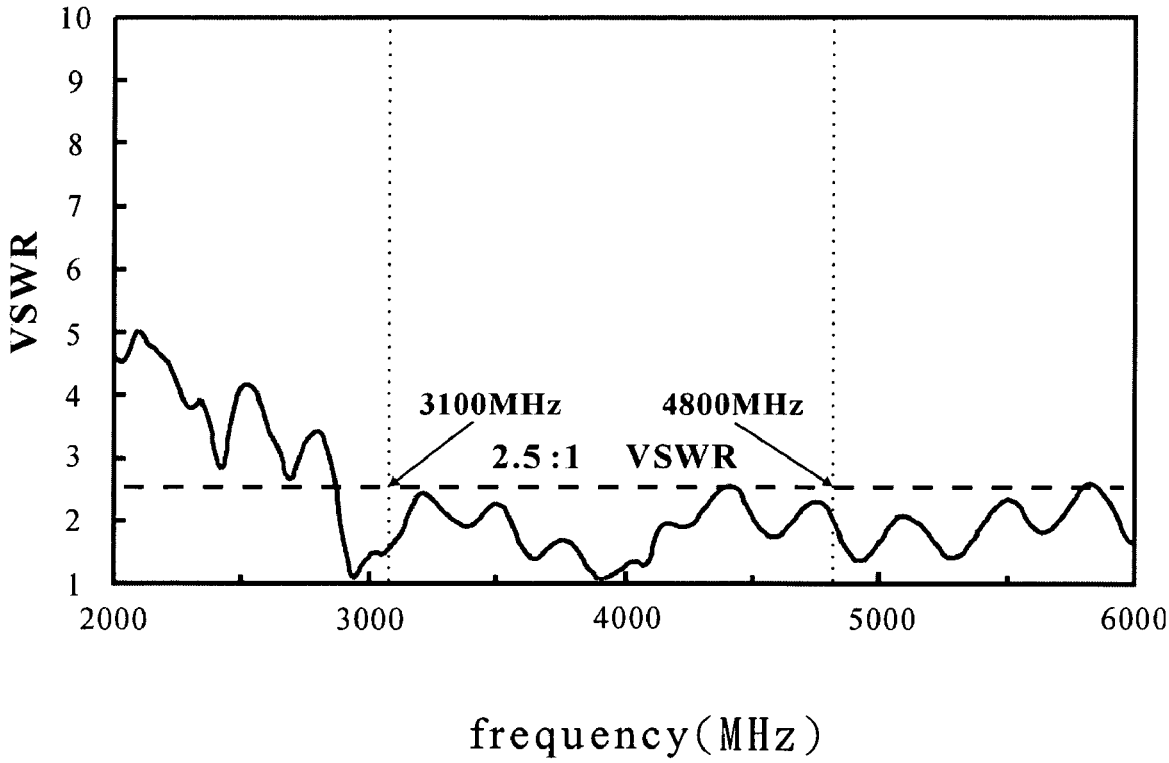
FIG. 4 is a plot illustrating a voltage standing wave ratio (VSWR) of the preferred embodiment.
Figure 5:
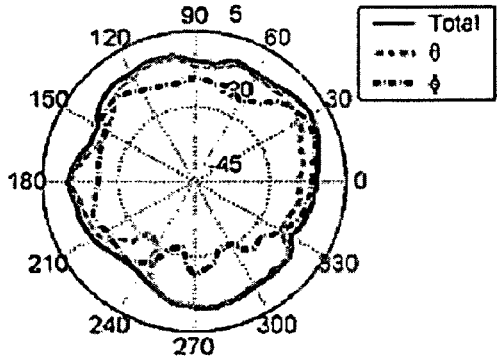
FIG. 5 shows plots of radiation patterns of the preferred embodiment respectively on the x-y, x-z, and y-z planes when operated at 3168 MHz.
Figure 5:
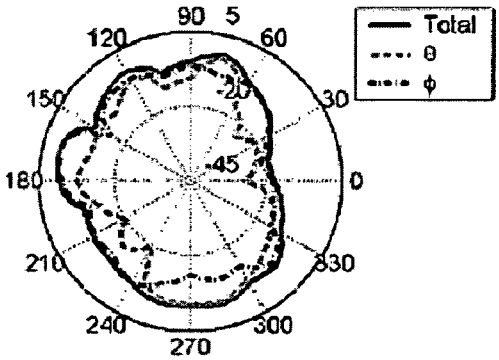
Figure 5:
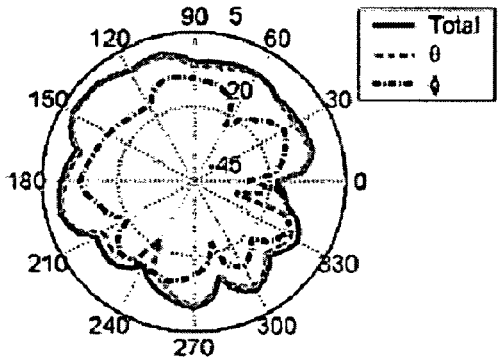
Figure 6:
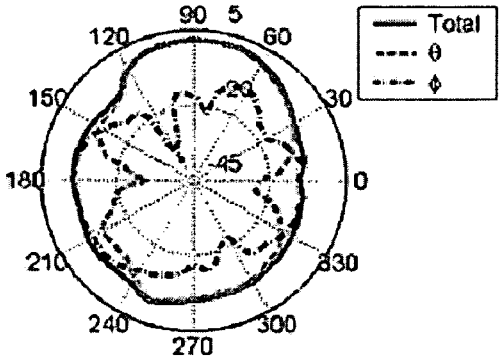
FIG. 6 shows plots of radiation patterns of the preferred embodiment respectively on the x-y, x-z, and y-z planes when operated at 3960 MHz.
Figure 6:
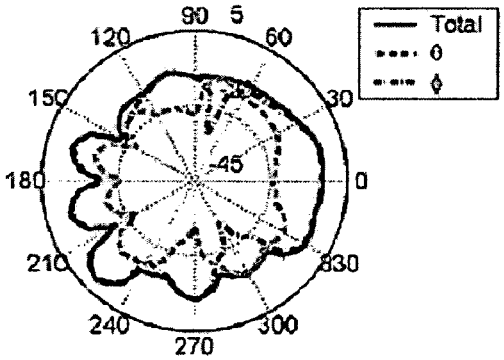
Figure 6:
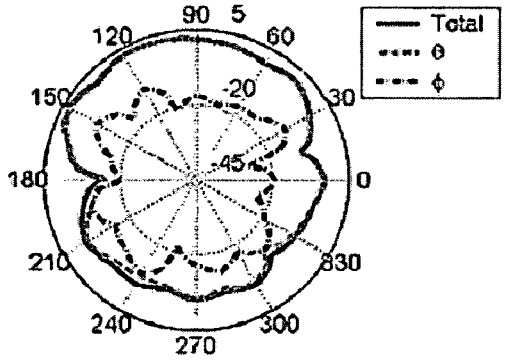
Figure 7:
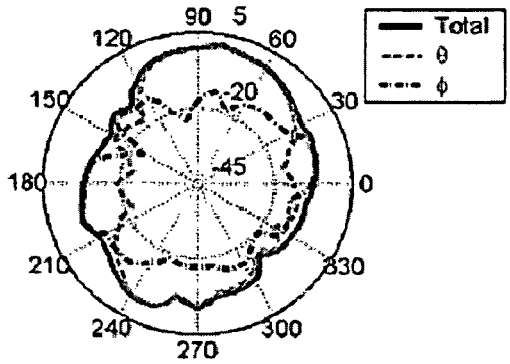
FIG. 7 shows plots of radiation patterns of the preferred embodiment respectively on the x-y, x-z, and y-z planes when operated at 4752 MHz.
Figure 7:
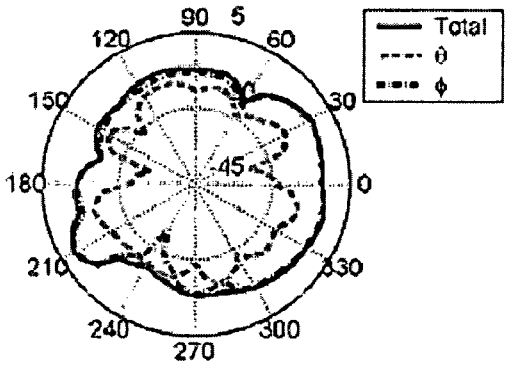
Figure 7:
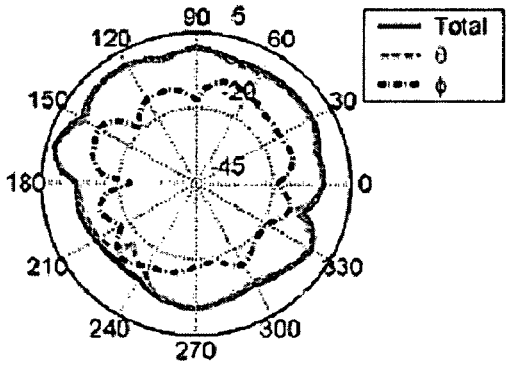

Experimental results, as illustrated in FIG. 4, shows that the antenna device 2 of this invention achieves a voltage standing wave ratio (VSWR) of less than 2.5 when operated within the UWB Band I. Moreover, as shown in Table I below, the antenna device 2 of this invention achieves satisfactory total radiation powers (TRP) and efficiencies when operated with in the UWB Band I. Further, as illustrated in FIG. 5, the antenna device 2 of this invention has substantially omnidirectional radiation patterns when operated at 3168 MHz. In addition, as illustrated in FIG. 6, the antenna device 2 of this invention has substantially omnidirectional radiation patterns when operated at 3960 MHz. Furthermore, as illustrated in FIG. 7, the antenna device 2 of this invention has substantially omnidirectional radiation patterns when operated at 4752 MHz.

TABLE I

| Frequency (MHz) | TRP (dBm) | Radiation Efficiency (%) |
|---|---|---|
| 3168 | −5.06 | 31.21 |
| 3432 | −5.48 | 28.29 |
| 3696 | −4.21 | 37.93 |
| 3960 | −3.53 | 44.41 |
| 4224 | −3.82 | 41.47 |
| 4488 | −4.08 | 39.08 |
| 4752 | −4.64 | 34.37 |

It has thus been shown that the antenna device 2 of this invention includes a dual-loop radiating element that has first and second loops 5, 6, first and second radiating arms 8, 7, each of which is disposed in a respective one of the first and second loop 5, 6, a feeding element 3 that interconnects the first and second loops 5, 6 and the first and second radiating arms 8, 7, and a grounding element 4 connected to the first and second loops 5, 6. The construction as such simplifies the structure of the antenna device 2, permits easy adjustment of the first and second resonant frequencies of the antenna device 2, and widens a bandwidth of the antenna device 2.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. An antenna device, comprising:

a dual-loop radiating element having first and second loops, each of which has opposite first and second ends, each of said first and second ends of said first loop being connected to a respective one of said first and second ends of said second loop;

a first radiating arm disposed in said first loop;

a second radiating arm disposed in said second loop and connected to said first radiating arm;

a feeding element interconnecting a junction of said first ends of said first and second loops and a junction of said first and second radiating arms; and a grounding element connected to a junction of said second ends of said first and second loops.

2. The antenna device as claimed in claim 1, wherein said first loop includes first, second, and third sections, each of which has opposite first and second ends, each of said first and second ends of said third section being connected to a respective one of said second end of said first section and said first end of said second section, said first end of said first section of said first loop defining said first end of said first loop, said second end of said second section of said first loop defining said second end of said first loop, each of said first and second ends of said second loop being connected to a respective one of said first end of said first section and said second end of said second section.

3. The antenna device as claimed in claim 2, wherein said first and second sections of said first loop are parallel.

4. The antenna device as claimed in claim 3, wherein said first radiating arm is parallel to said first and second sections of said first loop.

5. The antenna device as claimed in claim 2, wherein said first section of said first loop is flat and extends along a plane, and each of said first and second radiating arms is flat and extends along a second plane transverse to the plane.

6. The antenna device as claimed in claim 2, wherein said second section of said first loop is flat and extends along a plane, and each of said first and second radiating arms is flat and extends along a second plane transverse to the plane.

7. The antenna device as claimed in claim 1, wherein said second loop includes first, second, and third sections, each of which has opposite first and second ends, each of said first and second ends of said third section being connected to a respective one of said second end of said first section and said first end of said second section, said first end of said first section of said second loop defining said first end of said second loop, said second end of said second section of said second loop defining said second end of said second loop, each of said first and second ends of said first loop being connected to a respective one of said first end of said first section and said second end of said second section.

8. The antenna device as claimed in claim 7, wherein said first and second sections of said second loop are parallel.

9. The antenna device as claimed in claim 8, wherein said second radiating arm is parallel to said first and second sections of said second loop.

10. The antenna device as claimed in claim 7, wherein said first section of said second loop is flat and extends along a plane, and each of said first and second radiating arms is flat and extends along a second plane transverse to the plane.

11. The antenna device as claimed in claim 7, wherein said second section of said second loop is flat and extends along a plane, and each of said first and second radiating arms is flat and extends along a second plane transverse to the plane.

12. The antenna device as claimed in claim 1, wherein said feeding and grounding elements are collinear.

13. The antenna device as claimed in claim 1, wherein said first loop is associated operably with said feeding and grounding elements to generate a first resonant frequency, and said second loop is associated operably with said feeding and grounding elements to generate a second resonant frequency, each of said first and second radiating arms having a predetermined length and a predetermined impedance such that each of the first and second resonant frequencies is between 3.1 GHz and 10.6 GHz.

14. The antenna device as claimed in claim 1, wherein said first loop is associated operably with said feeding and grounding elements to generate a first resonant frequency, and said second loop is associated operably with said feeding and grounding elements to generate a second resonant frequency, each of said first and second radiating arms having a predetermined length and a predetermined impedance such that each of the first and second resonant frequencies is between 3168 MHz and 4752 MHz.

15. The antenna device as claimed in claim 1, further comprising a securing member connected to one of said first and second loops and formed with a hole therethrough.

16. The antenna device as claimed in claim 1, further comprising a copper foil element connected to said grounding element and adapted to be connected to an electrical ground.

* * * * *